United States Patent [19]

Turner

[11] Patent Number: 4,974,430

[45] Date of Patent: Dec. 4, 1990

[54] ADHESIVELY SECURED EARRING

[76] Inventor: Sue S. Turner, 6314 Macon Rd., Columbia, S.C. 29209

[21] Appl. No.: 421,289

[22] Filed: Oct. 13, 1989

[51] Int. Cl.[5] ..... A44C 7/00

[52] U.S. Cl. ..... 63/12; 63/14.8; 63/DIG. 1; 24/304

[58] Field of Search ..... 63/12, 14.1, 14.2, 14.8, 63/29.1, DIG. 1; 24/304

[56] References Cited

U.S. PATENT DOCUMENTS

| | | | |
|---|---|---|---|
| 1,106,388 | 8/1914 | Juergens . | |
| 1,978,652 | 10/1934 | Shea | 63/14.8 |
| 2,364,872 | 12/1944 | Rich . | |
| 2,510,511 | 6/1950 | Mittendorf . | |
| 2,842,825 | 7/1958 | Bangs . | |
| 2,936,600 | 5/1960 | Crigler . | |
| 3,630,810 | 12/1971 | Mauro | 63/DIG. 1 X |
| 3,831,398 | 8/1974 | Davis, Sr. | 63/DIG. 1 X |

*Primary Examiner*—Laurie K. Cranmer
*Attorney, Agent, or Firm*—Dority & Manning

[57] ABSTRACT

A device for securing an ornament or earring to an earlobe is provided having a strip of pliant material, the strip of material being adapted for location about a portion of the earlobe, the strip of material having adhesive at opposite ends for removable securement to opposite sides of the earlobe and adhesives on one of the opposite ends for removable securement of an ornament.

9 Claims, 1 Drawing Sheet

ADHESIVELY SECURED EARRING

BACKGROUND OF THE INVENTION

The present invention relates generally to earrings or other ornaments which may be adhesively secured to the human ear.

In the past, the art of earring construction has focused on two primary structures, users having pierced ears have employed earrings with wires or posts for insertion through holes in the earlobes. Clip-on earrings have provided an alternative means of ornamentation.

Additionally, earrings secured to the user's ear by means of an adhesive have been taught. U.S. Pat. No. 2,936,600 to Crigler discloses an adhesive strip which sits on the floor of the concha of the ear with a connector eye means extending downwardly for receipt of a connector pin as would normally be inserted through the hole of a pierced ear. Thus, although an ornament in accordance with Crigler would be positioned at the earlobe, the adhesive tape is above the earlobe within the entrance of the ear canal.

U.S. Pat. No. 2,364,872 to Rich discloses a hollow ear ornament with a fastening element on the back thereof for attachment to an adhesive strip which may be secured to the user's earlobe.

Other examples of prior art which have provided alternatives to pierced ear earrings and conventional clip-on earrings include U.S. Pat. No. 1,106,388 to Juergens which discloses a device for converting a pierced ear earring into a clip-on, U.S. Pat. No. 2,510,511 to Mittendorf which discloses a clip-on earring with an irregular clipping surface such that reduced clipping pressure is required, and U.S. Pat. No. 2,842,825 to Bangs which discloses a novel clip-on earring employing spring tension. Nothing in the prior art discloses the use of a single adhesive strip which is secured to the ornamental structure of the earring on one side thereof and the earlobe on the other side thereof. Additionally, the prior art does not disclose the use of a strip of pliant material for reinforcing a user's earlobe while wearing heavy pierced ear earrings.

SUMMARY OF THE INVENTION

Accordingly, it is an object of the present invention to provide a simplified earring structure which may be adhesively secured to the user's ear.

It is a further object of the present invention to provide an earring which adheres to the user's earlobe without intruding into the ear.

It is yet another object of the present invention to provide a novel means for adhering an ornament to an earlobe.

It is a further object of the present invention to provide a means for further supporting the wire or post of a heavy pierced ear earring which is carried through the hole of a pierced earlobe.

These as well as other objects of the present invention are achieved by providing an apparatus for securing an ornament such as an earring or the like to an earlobe comprising a strip of pliant material, the strip of material being adapted for location about a portion of the earlobe, the strip of material having means at its opposite ends for removable securement to the opposite sides of the earlobe, and means located on at least one of the opposite ends of the strip for securement of an ornament to the strip.

DETAILED DESCRIPTION OF THE DRAWINGS

DESCRIPTION OF A PREFERRED EMBODIMENT

The scope of the present invention encompasses a strip of pliant material which may be secured to an earlobe presenting a means, preferably an adhesive surface, for securement of an ornament thereto. Additionally, the pliant strip of the present invention is employed in further securing a pierced ear earring. The strip of the present invention is preferably a polymeric material with adequate flexibility to accurately follow the contours of an earlobe. Thus, a polymeric material such as is employed in the manufacture of nonallergic medical tape is particularly suited for use in the present invention. Additionally, the strip is preferably provided in various flesh tones although bright, noticeable colors including metallic gold or silver are also within the scope of the invention.

Figure 1:
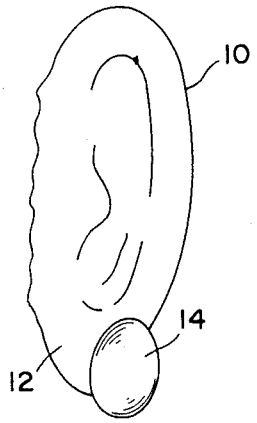
FIG. 1 is a perspective view of an ornament secured to an earlobe in accordance with the present invention.

Referring more particularly to the drawings, FIG. 1 is a perspective view of an ear 10 having an ornament 14 secured to the earlobe 12. At a lower portion of the lobe, a small portion of strip 16 is visible.

Figure 2:
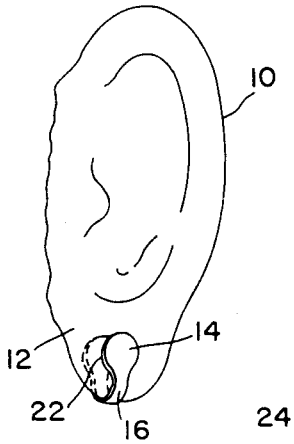
FIG. 2 is a perspective view of an ear having a strip of pliant material in accordance with the present invention secured to the earlobe with the end of the strip which is secured to the rear portion of the lobe represented in phantom.
Figure 3:
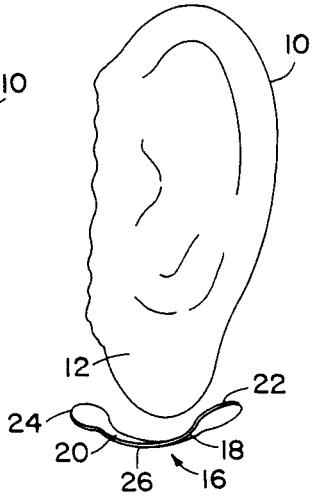
FIG. 3 is a perspective view of an ear with a strip of pliant material in accordance with the present invention positioned for securement about the earlobe.

Strip 16, better represented in FIGS. 2 and 3, is a strip of pliant material preferably having means for removable securement such as an adhesive on at least some portions of both sides 18 and 20 thereof. Strip 16 preferably comprises enlarged ends 22 and 24 connected by intermediate segment 26. In one embodiment, both sides 18 and 20 are completely coated with an adhesive such that either side 18 or 20 may be secured to the lobe as in FIG. 2 and either end 22 or 24 may be presented on the front portion of the lobe 12 for securement of an ornament such as 14 thereon.

Figure 4:
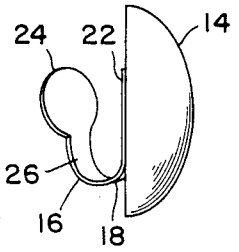
FIG. 4 is a perspective view of an ornament secured to a strip of pliant material in accordance with the present invention illustrating an alternative securement means in phantom.
Figure 6:
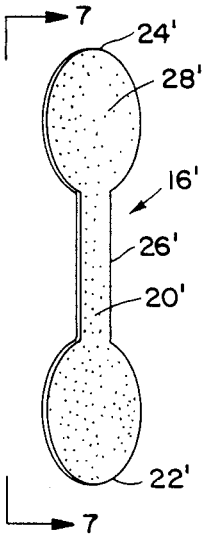
FIG. 6 is a perspective view of one embodiment of the strip of pliant material in accordance with the present invention.
Figure 7:
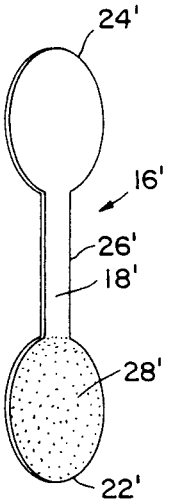
FIG. 7 is a perspective view taken along the line 7—7 of FIG. 6.

FIG. 4 is a side perspective view of the ornament 14 secured to strip 16 prior to securement to the lobe 12. It should be noted that the strip may be first secured to the earlobe with the ornament later secured thereto, or the strip may be first secured to the ornament with both the ornament and the strip later secured to the lobe. In this regard, a permanent adhesive could be employed at a side of the material to receive the ornament with a removably securable adhesive on the sides for securement to the earlobe. Furthermore, as is represented in phantom at FIG. 4, some other means, such as the staple 17 shown, may be employed to permanently secure the strip 16 to ornament 14. In such an embodiment, the ornament, in combination with the strip, may be sold as a disposable unit. FIG. 4 illustrates strip 16 secured at end 22 on side 18 to the ornament 14. Side 20 is preferably completely coated with an adhesive at both ends 22 and 24 and intermediate segment 26 for optimum securement to the lobe, and therefore, increased support for the weight of ornament 14. Alternatively, side 20 may carry an adhesive only at ends 22 and 24. Similarly, side 18 may be completely coated at ends 22, 24 and intermediate segment 26. Optionally, strip 16 may be provided with adhesive coatings as is represented in FIGS. 6 and 7. In FIG. 6, strip 16' is shown with an adhesive coating 28' covering side 20' at both ends 22' and 24' and intermediate segment 26'. FIG. 7, taken along the line 7—7 of FIG. 6, illustrates side 18' of strip 16' having an adhesive coating 28' only at one end 22' thereof. End 24' and intermediate segment 26' do not carry an adhesive coating. This embodiment prevents hair, which falls behind the earlobe, from adhering to the strip.

Figure 5:
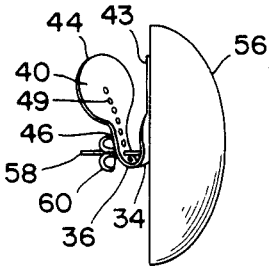
FIG. 5 is a perspective view of a pierced ear earring secured to a strip of pliant material with the post of the earring threaded through the strip of material in accordance with the present invention.

FIG. 5 illustrates an alternative embodiment wherein strip 36, having sides 38 and 40, opposite ends 42 and 44 and intermediate segment 46, is adhered to the rear portion of a pierced ear earring 56. A line of perforations 49 is defined through the strip along the midline of end 42, segment 46 and end 44, for accommodating the post or wire 58 of earring 56. The use of strip 36 along with post 58 of a pierced ear earring lends support to the weight of a heavy earring and prevents pulling of the pierced ear thereby. Of course, as above, strip 36 may be completely coated with an adhesive on both sides 38 and 40, partially coated on the two sides, or, as discussed below, coated only on side 40. Thus, the user threads the post 58 through one of the perforations 49 and preferably adheres the earring to the strip at end 42 of side 38. The post is extended through the hole in the user's pierced ear, with the strip adhering to the front of the user's earlobe at side 40 of end 42, and the strip is wrapped around the bottom of the earlobe with the post passing through another of the perforations 49 and the strip adhering to the rear of the lobe at end 44 on side 40. Thus, the earring is supported by both the post extending through the user's earlobe, and the strip adhered to the user's earlobe. Alternatively, strip 36 may carry an adhesive coating only on side 40 for securement to the earlobe such that the strip does *not* adhere to the ornament but merely reinforces the earlobe for supporting a pierced ear earring. Thus, the user extends the post of the earring through one of the performations 49 and through the pierce in the ear with the strip adhering to the user's earlobe at the side 40 of end 42. The strip is wrapped around the bottom of the earlobe with the post passing through another of the perforations 49 and the strip adhering to the rear of the lobe at end 44 on side 40. This reinforcement of the earlobe is particularly beneficial when the user wears heavy, dangling earrings.

Although the means for removable securement of the strip to the earlobe and an ornament has been referred to throughout as an adhesive coating, it is to be understood that any other means for securement including a layer of pliant material having adhesive properties is within the scope of the present invention. Additionally, the strip having an adhesive coating thereon may be further provided with releasable cover means, similar to the paper cover typically provided on an adhesive bandage.

These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to be limitative of the invention so further described in such appended claims.

That which is claimed is:

1. Apparatus for securing an ornament such as an earring or the like to an earlobe comprising:

a strip of a pliant material, said strip of material being adapted for location about a portion of said earlobe, said strip of material having adhesive means on one side and at opposite ends of same for removable securement of said strip to opposite sides of said earlobe, and adhesive means located on the other side and on one of said opposite ends of said strip for securement of an ornament thereto.

2. An apparatus as defined in claim 1 wherein said ornament is a pierced ear earring and said apparatus further includes at least one perforation defined through said strip for receiving a post of said pierced ear earring.

3. An earring, comprising:

an ornament;

a strip of a pliant material, said strip of material being adapted for location about a portion of said earlobe, said strip of material having adhesive means on one side and at opposite ends of same for removable securement of said strip to opposite sides of said earlobe, and adhesive means located on the other side and on one of said opposite ends of said strip for securement of an ornament thereto.

4. An apparatus for reinforcing a pierced earlobe for supporting an ornament such as an earring or the like comprising:

a strip having:

opposite sides, one of said sides at least partially coated with an adhesive;

opposite ends connected by an intermediate segment wherein one of said ends adheres to a rear portion of an earlobe and the other of said ends adheres to a front portion of said earlobe; and a plurality of perforations defined through said strip for receiving a post of a pierced ear earring, such that a post may be passed through one of the perforations at one end of said strip, extended through the pierce defined in the earlobe, and passed through one of the perforations at the opposite end of said strip such that said strip reinforces the pierce in supporting the earring.

5. An apparatus as defined in claim 4 wherein the other of said opposite sides of said strip includes an adhesive coating thereon at one of said opposite ends for adhering to and further supporting said earring.

6. Apparatus for securing an ornament to an ear comprising a strip of pliant material, said strip including enlarged terminal areas at opposite ends of same with a connector section therebetween, said connector section being lesser in width than said terminal areas, said strip having adhesive means on at least one side surface of said terminal areas for securement of said strip to opposite sides of an earlobe and at least one of said terminal areas having adhesive means thereon for securement of an ornament thereto.

7. Apparatus as defined in claim 6 comprising further releasable cover means over said surfaces of said strip having adhesive means thereat.

8. Apparatus as defined in claim 6 wherein said strip has a flesh tone color.

9. Apparatus for securing an ornament to an earlobe comprising:

a continuous strip of pliant, flesh colored material, said strip including enlarged terminal ends, each end having an adhesive means on one side thereof for securement of said ends to opposite sides of said earlobe, one of said ends further having an adhesive means on the opposite side thereof for securement of an ornament thereto.

* * * * *